United States Patent [19]

Puckett

[11] 4,318,419

[45] Mar. 9, 1982

[54] PERMANENT WAVE MAINTAINING APPARATUS

[76] Inventor: Nathan J. Puckett, 50 King St., New York, N.Y. 10014

[21] Appl. No.: 216,193

[22] Filed: Dec. 15, 1980

[51] Int. Cl.[3] ..... A45D 2/00

[52] U.S. Cl. ..... 132/40

[58] Field of Search ..... 132/40, 42, 39, 9

[56] References Cited

U.S. PATENT DOCUMENTS 2,677,380 5/1954 Schoendorf ..... 132/42 R 3,768,492 10/1973 Scott ..... 132/39

FOREIGN PATENT DOCUMENTS 1358440 3/1964 France ..... 132/40

*Primary Examiner*—G. E. McNeill

*Attorney, Agent, or Firm*—Robert K. Youtie

[57] ABSTRACT

Apparatus for maintaining a permanent wave upon hair growth without reprocessing previously waved hair, including a core or spool for winding up a previously waved hair end portion and having a spool enlargement on one end, an enclosure having an opening and a slot extending from the opening for receiving the hair wound spool with the enlargement closing the enclosure opening and the hair extending through the slot, and a flexible seal along the slot retained in closing engagement therewith by externally wound hair.

6 Claims, 7 Drawing Figures

FIG. 4
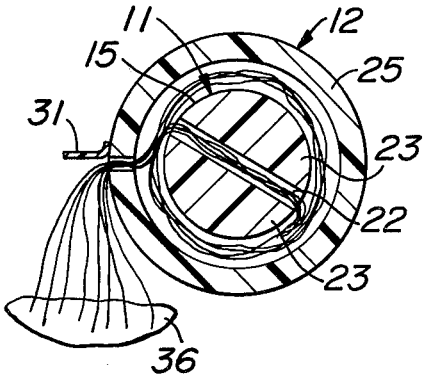
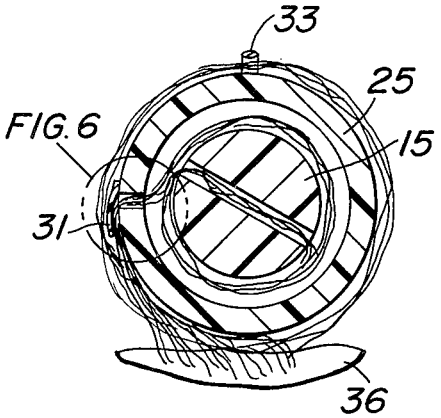
FIG. 5
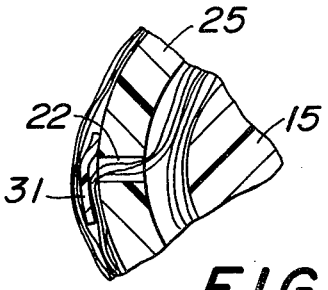
FIG. 6
FIG. 7
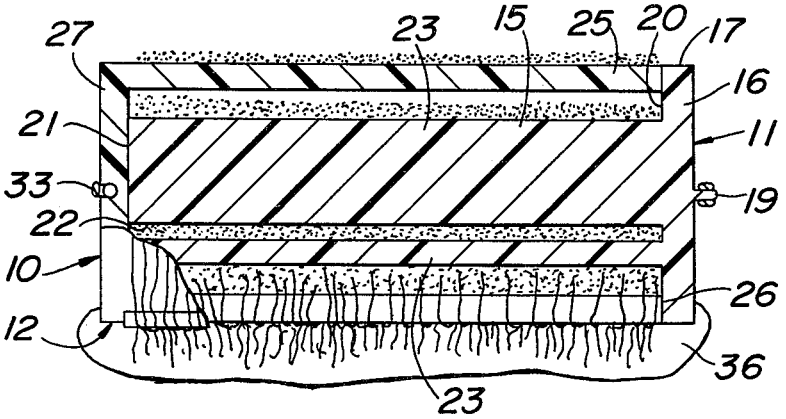

PERMANENT WAVE MAINTAINING APPARATUS

BACKGROUND OF THE INVENTION

It is well known in the field of hair dressing and hair styling that a problem exists in maintaining the attractiveness of a permanent wave after new hair growth has occured, so as to leave an unwaved hair portion of new growth between the permanently waved hair portion and the head. Heretofore it has been common practice to again permanently wave all of the hair, in order to permanently wave the new growth. This is not satisfactory as repeated permanent waving may have deleterious effects upon the hair.

While the concept of separately waving the new growth only has been suggested and attempted, it has not been satisfactorily accomplished. The prior art of which applicant is aware consists of the following:

| U.S. PAT. NO. | NAME |
|---|---|
| 1,400,637 | Szlanyi |
| 2,819,721 | Zakon |
| 2,991,790 | Bonilla |
| 3,943,946 | Gallegos |

SUMMARY OF THE INVENTION

It is an important object of the present invention to provide apparatus for permanently waving only the new growth of previously permanently waved hair, which apparatus is extremely simple in construction, for quick and easy operation, being substantially foolproof in use and entirely reliable throughout a long useful life.

It is a more specific object of the present invention to provide an inner core for winding the previously waved hair, and an outer enclosure for receiving in sealed relation the hair wound core and about which the new growth of hair may be wound for separate permanent waving.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 4 is a transverse sectional view taken generally along the line 4—4 of FIG. 2.

FIG. 5 is a transverse sectional view taken generally along the line 5—5 of FIG. 3.

FIG. 6 is an enlarged fragmentary view of the region 6 shown in FIG. 5.

FIG. 7 is a longitudinal sectional view taken generally along the line 7—7 of FIG. 3.

DESCRIPTION OF THE PREFERRED EMBODIMENT

Figure 1:
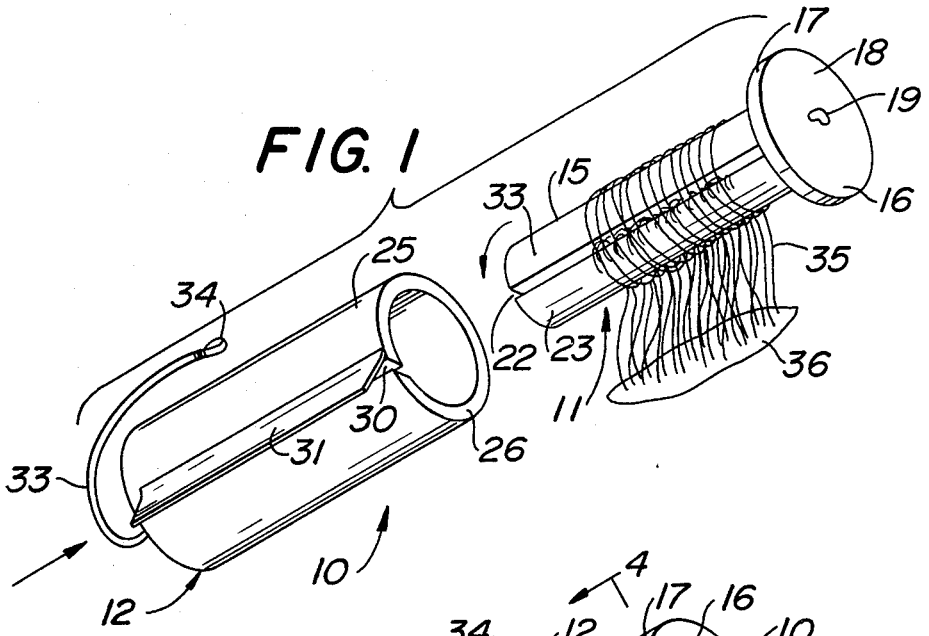
FIG. 1 is an exploded perspective view illustrating the instant hair waving apparatus in an early stage of its operation.

Referring now more particularly to the drawings, and specifically to FIG. 1 thereof, the device is there generally designated 10, and includes an inner core or spool 11 and an outer enclosure or housing 12.

The core or spool 11 may be a generally cylindrical body or rod 15 having at one end a disc shaped enlargement or closure 16, generally coaxial with the core or body 15. The end enlargement, head or closure 16 is also generally cylindrical, including a cylindrical peripheral surface 17 bounding a generally flat outer side or surface 18. A fastener element or hook 19 may be located generally centrally of the outer closure surface 18.

The cylindrical core body or rod 15 extends coaxially from the opposite or inner surface 20, see FIG. 7, of the end enlargement or closure 16, generally normal thereto.

The cylindrical rod or core 15 may be of generally constant cross-sectional configuration throughout its length, and may terminate at a free end 21 generally parallel to the disc-like closure 16. A slot or cut 22 may extend longitudinally inwardly of the core or spool 15, through the free end 21, terminating proximate to the enlargement or closure 16. The cut or slit 22 may be generally diametral or chordal, to bifurcate the spool into a pair of parallel sections or legs 23, which may be resiliently yieldably displacable toward and away from each other, for frictionally grasping hair strands, as will appear more fully hereinafter.

The housing or enclosure 12 may include a hollow, generally cylindrical body or shell 25, having one end open, as at 26, and having its opposite end closed by an end wall 27, see FIG. 6. The enclosure or housing 25 may be of constant cylindrical cross-sectional configuration throughout its length between the end closure 27 and the open end 26, and may have its external diameter substantially equal to the external diameter 17 of the enlargement or closure 16. Further, the internal diameter of the housing 25 is appreciably larger than the diameter of the core or spool 15, so as to leave between the spool and housing a generally cylindrical space, for a purpose appearing more fully hereinafter.

In addition, the cylindrical housing or enclosure shell 25 is provided with a longitudinal slot or slit 30 extending inwardly through the open end 26 and terminating substantially at the end wall 27. The slot or slit 30 may open generally radially through the shell 25. In addition, a generally rectangular flap, seal or lip 31 may extend longitudinally along the exterior of the shell 25, closely adjacent to the slot 30, being suitably secured thereto, and be swingable into and out of a sealing, overlying relation with the slot. The flap or seal 31 may be resiliently or compliantly flexible for flexure into overlying relation with the slot 30 and hair passing through the slot, to effectively seal the slot to the passage of liquid, as will appear presently.

The core or spool 11 is adapted for assembly with the housing or enclosure 12 by longitudinal, spaced axial insertion of the core rod 15 inwardly through the open end 26 of the housing until the core end enlargement 16 engages the housing end 26 to close the latter. In this condition, the core end 21 is proximate to the end wall 27 of the housing, as best seen in FIG. 6. Suitable retaining means may be employed to secure the core or spool 11 in the above described assembled relation with the housing 12.

Figure 3:
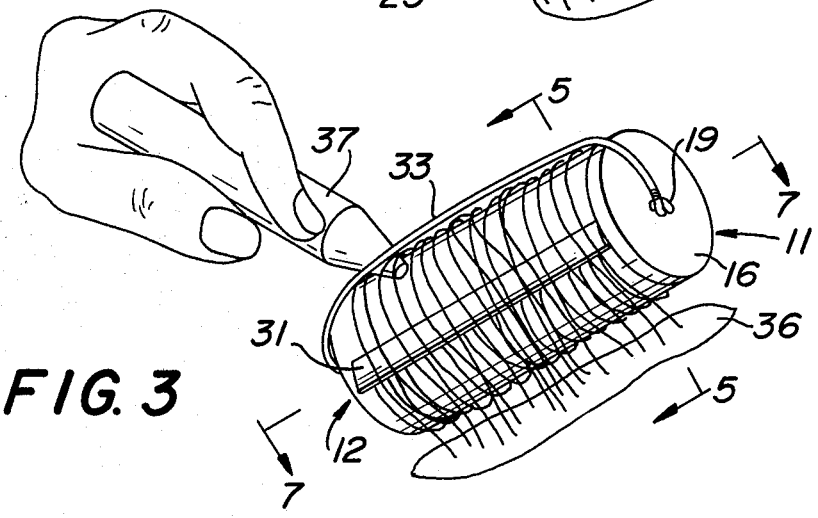
FIG. 3 is a perspective view showing a later stage of its operation.

By way of example, a resiliently extensile or elastic retaining member or cord 33 may have one end anchored to the end wall 27, and may have its other end provided with a loop or eye 34 for resilient extension into hooked engagement with fastener element 19, as best seen in FIG. 3.

OPERATION

Figure 2:
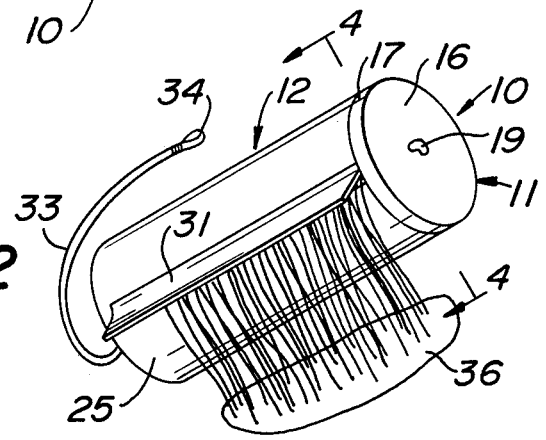
FIG. 2 is a perspective view of the instant apparatus showing an intermediate stage of its operation.

Operation of the above described apparatus is initiated by inserting the end of a hair strand into the core slot 22, and winding the hair 35 about the core rod 15. That is, the previously permanently waved end portion of the hair strand is wound about the core rod 15, and the remaining, unwaved new growth portion of the hair strand is left unwound. In this condition, the core rod 15 and previously waved and wound hair end portion are inserted into the interior of housing 12, with the hair strand passing laterally into the slot 30 and exending through and out of the slot to the exterior of the housing 12. That is, the unwaved new hair growth extends exteriorly of the housing 12 to the user's head. This unwaved new growth portion of the hair strand is coiled or wound exteriorly about the housing 12, as from the condition of FIG. 2 to the condition of FIG. 3, wherein the exteriorly wound hair portion closely overlies the flap or seal 31 to aid in maintaining the latter in compliant sealing engagement with the hair (see FIGS. 5 and 6), to effectively prevent the passage of liquid through the slot 22.

In this condition, with the unwaved new growth hair portion wound exteriorly about the housing 12, to the scalp 36 as seen in FIGS. 3 and 7 or otherwise as desired, the retainer cord 33 is stretched over the externally wound hair and interengaged with the fastener element 19. In this condition the assembly is self retaining and the permanent waving solution may be applied, as shown by the applicator 37 in FIG. 3. During application of the chemicals in the prescribed manner, it will be appreciated that the previously waved hair is protectively enclosed within the housing 12, and that only the unwaved new growth receives the waving application.

After suitable waving of the new growth, the apparatus 10 may be disassembled by reversal of the hereinbefore described procedure, and the entire strand is suitably permanently waved, without multiple application of waving material to any hair portion.

From the foregoing, it is seen that the present invention provides apparatus for maintaining a permanent wave upon hair growth without reprocessing previously waved end portions of hair, which apparatus is extremely simple in construction for manufacture and sale at a reasonable price, durable and entirely reliable in operation throughout a long useful life, and which otherwise accomplishes its intended objects.

Although the present invention has been described in some detail by way of illustration and example for purposes of clarity of understanding, it is understood that certain changes and modifications may be made within the spirit of the invention.

What is claimed is:

1. Apparatus for maintaining a permanent wave upon hair growth without reprocessing previously waved end portions of hair, said apparatus comprising a generally cylindrical core for winding thereabout of a previously waved hair end portion, an enlarged closure on one end of said core, a cylindrical housing having one end open and the other end closed and formed with a longitudinal slot extending inwardly from said open housing end, said housing being internally sized to spacedly receive said core with said closure in closing engagement with said open end of said housing so that the core-wound previously waved hair is inside the housing and the next adjacent hair extends through said slot exteriorly of said housing for winding about said housing, and a seal on said housing for effectively sealing said slot with hair extending through said slot, whereby the externally housing-wound hair may be processed by soaking with solution while the core-wound hair is effectively sealed from the solution.

2. Apparatus according to claim 1, said core including resilient hair gripping means.

3. Apparatus according to claim 1, in combination with retaining means for holding said core in said housing and housing-wound hair in position relative to said housing.

4. Apparatus according to claim 3, said retaining means comprising an elastic element extending between the closed end of said housing and said closure.

5. Apparatus according to claim 1, said closure comprising a head in closing engagement with the open end of said housing when said core is received in said housing.

6. Apparatus according to claim 1, said seal comprising a compliant lip extending along said slot and biased toward slot closing relation by the externally housing-wound hair.

* * * * *